United States Patent [19]

Dougan

[11] 4,408,665

[45] Oct. 11, 1983

[54] IN SITU RECOVERY OF OIL AND GAS FROM WATER-FLOODED OIL SHALE FORMATIONS

[75] Inventor: Paul N. Dougan, County of Salt Lake, Utah

[73] Assignee: Equity Oil Company, Salt Lake City, Utah

[21] Appl. No.: 947,994

[22] Filed: Oct. 2, 1978

Related U.S. Application Data

[63] Continuation-in-part of Ser. No. 793,404, May 3, 1977, abandoned.

[51] Int. Cl.[3] ..... E21B 43/24; E21B 43/40

[52] U.S. Cl. ..... 166/266; 166/52; 166/57; 166/267; 166/272

[58] Field of Search ..... 166/272, 269, 303, 265–267, 166/57, 52, 75 R

[56] References Cited

U.S. PATENT DOCUMENTS

| | | | |
|---|---|---|---|
| 2,148,717 | 2/1939 | Whitney | 166/272 |
| 3,129,758 | 4/1964 | Closmann | 166/272 X |
| 3,273,640 | 9/1966 | Huntington | 166/272 X |
| 3,352,355 | 11/1967 | Putman | 166/272 X |
| 3,400,762 | 9/1968 | Peacock et al. | 166/272 X |
| 3,501,201 | 3/1970 | Closmann et al. | 166/272 X |
| 3,516,495 | 6/1970 | Patton | 166/272 |
| 3,741,306 | 6/1973 | Papadopoulos et al. | 166/272 X |
| 3,804,169 | 4/1974 | Closmann | 166/272 X |
| 4,026,359 | 5/1977 | Closmann | 166/272 X |

FOREIGN PATENT DOCUMENTS

| | | | |
|---|---|---|---|
| 985640 | 3/1965 | United Kingdom | 166/272 |

*Primary Examiner*—Stephen J. Novosad
*Attorney, Agent, or Firm*—Mallinckrodt & Mallinckrodt

[57] ABSTRACT

Shale oil gas is recovered in situ from water-flooded, naturally porous, subterranean oil shale formations by injecting superheated steam under pressure into such formations through injection boreholes extending into the formations. Heat is transferred from the superheated steam to the oil shale, thereby in effect retorting the oil shale and converting the organic (kerogen) content thereof into oil in liquid or vapor form, usually accompanied by some gas. The released shale oil and gas are collected in the water naturally occurring in such a formation and in water resulting from the condensation of the injected steam and are recovered through extraction boreholes by moving both the water and the collected shale oil products to the surface through such boreholes. This is normally effected by pressure of the injected steam, but may be aided, if necessary, by pumping from the extraction boreholes. At the surface, the recovered shale oil products are separated from the water, at least part of the latter being treated for and then used in the generation of superheated steam. The remainder may be returned to the formation, as water.

11 Claims, 3 Drawing Figures

IN SITU RECOVERY OF OIL AND GAS FROM WATER-FLOODED OIL SHALE FORMATIONS

RELATED APPLICATION

The present application is a continuation-in-part of similarly entitled, copending application Ser. No. 793,404, filed May 3, 1977, now abandoned.

BACKGROUND OF THE INVENTION

1. Field

The invention relates to in situ recovery of shale oil and gas from naturally porous, water-flooded, subterranean oil shale formations.

2. State of the Art

Due to the relative high cost of mining oil shale for subsequent, above-ground processing, efforts are continually being made to recover the kerogen, i.e. the organic content, from the shale in situ. Heretofore, such efforts have been largely directed to thermal decomposition of the kerogen by burning a portion thereof in situ to supply much or all of the decomposing heat required. In other instances, hot fluids have been circulated through the shale after it has been rendered pervious in one way or another.

In some instances, oil shale formations are naturally fractured and pervious. This is true of certain oil shale strata occurring in the Parachute Creek member of the Green River formation in the Piceance Creek Basin of northwestern Colorado. However, these strata are generally flooded with water. The fractured nature of the strata and the water flooding make mining and the usual in situ recovery techniques impractical.

SUMMARY OF THE INVENTION

The present invention provides a feasible method for recovering what is indicated to be superior quality shale oil from those subterranean, water-flooded, oil shale formations which are characterized by natural fracture and vugular porosity and permeability. Superheated steam for supplying heat is injected into the water-flooded, naturally porous formation through injection boreholes, which are preferably positioned substantially uniformly throughout the areal extent of the portion of the formation that is to be worked.

The water contained in the water-flooded oil shale formation and the water resulting from condensation of the steam act as a vehicle to carry heat to the oil shale. Such water is also used as a collector and carrier of the oil released from the shale and, following separation of the oil therefrom and conditioning (the water is usually saline), may be sent to the steam generator and superheater to thereby conserve both water and heat.

The mixture of water and shale oil products is recovered from the porous, oil shale formation through extraction boreholes, and the oil and water are separated by the use of known techniques. At least a portion of the water is normally conditioned and used to generate more superheated steam for injection into the formation. Any portion of the water which is not so used may be introduced, as is, into the formation through one or more of the injection boreholes to aid in carrying shale oil and gas toward the extraction boreholes.

Pressure of the injected steam is normally sufficient to cause flow of water toward the extraction boreholes, but such flow may be aided if required or found desirable by suction applied to the extraction boreholes as by means of pumps. The sweep of heated water through the oil shale formation aids in dislodging evolved shale oil and gas from the natural openings and passages present in such formation. The water flooding the formation tends to localize the applied heat and prevents its dissipation throughout the formation.

THE DRAWINGS

The best mode presently contemplated for carrying out the invention is illustrated in the accompanying drawing, in which:

FIG. 1 is a schematic pictorial view of a block of ground containing a subterranean, naturally water-pervious and water-flooded, oil shale stratum into which have been drilled injection and extraction boreholes and at the surface of which has been installed facilities for aiding in the carrying out of the process of the invention;

FIG. 2, a fragmentary vertical section taken through a combined injection and extraction borehole of a different installation in a similar oil shale formation; and FIG. 3, a schematic showing of a particular arrangement of injection wells and extraction well in a somewhat different type of oil shale formation.

DETAILED DESCRIPTION OF THE ILLUSTRATED EMBODIMENTS

Present indications are that, in accordance with the invention, superior quality shale oil can be recovered from subterranean, water-flooded formations of oil shale which is characterized by natural permeability to water flow by reason of shale fracture and vugular porosity. So far as has been presently ascertained, the shale oil has a lower pour point, higher API gravity, and contains more light ends than shale oil produced in the usual retorts operated above ground.

Figure 1:
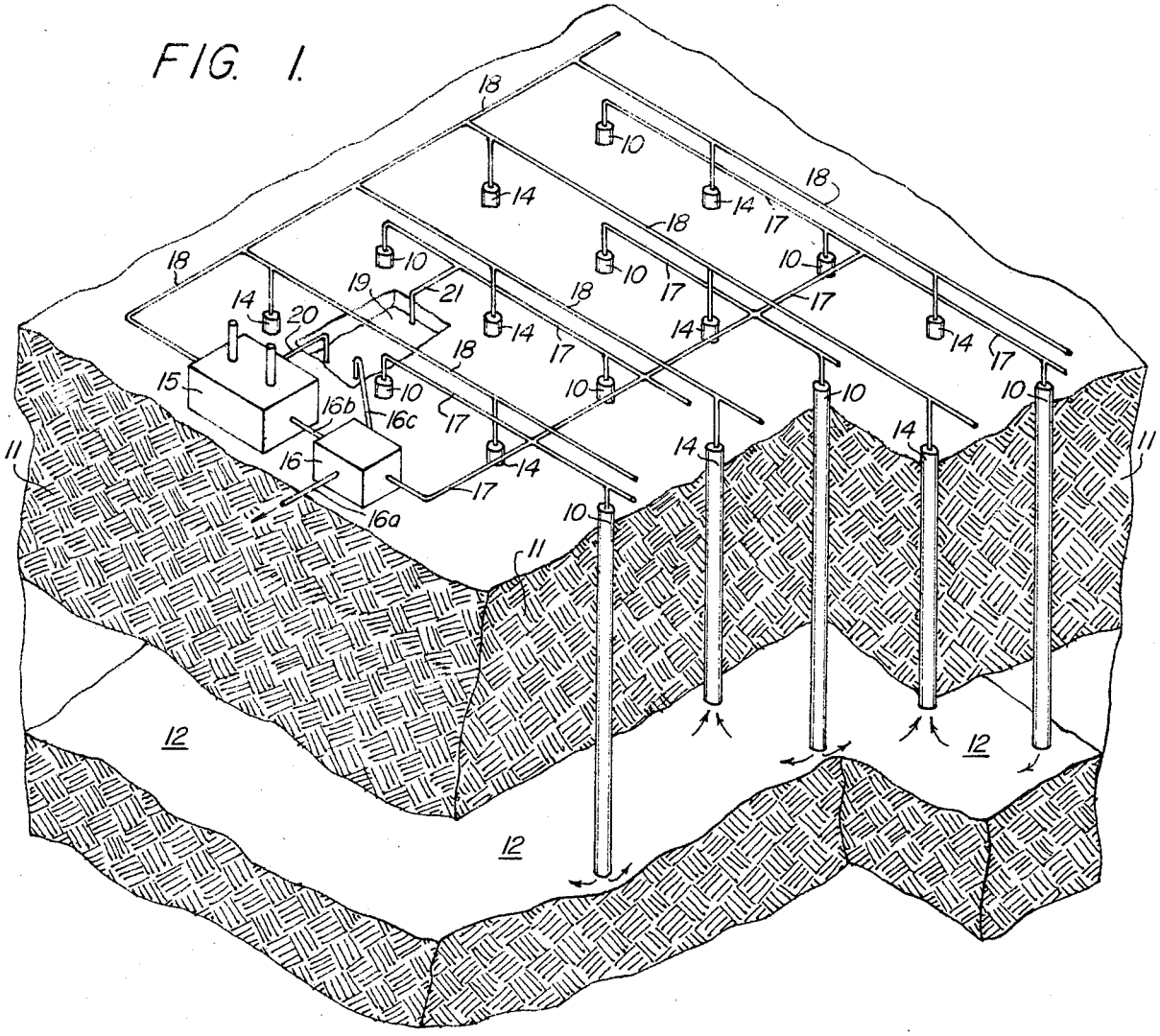

As illustrated in FIG. 1, which is typical of application of the invention to the Parachute Creek member of the Green River formation in the Piceance Creek Basin of northwestern Colorado, a series of mutually spaced, injection boreholes 10 are drilled through overburden 11 into a stratum 12 of naturally porous, water-flooded oil shale. At least a part of the height of such overburden lying immediately above stratum 12 is impermeable oil shale and such stratum 12 is underlaid by an impermeable stratum 13 of oil shale. Such boreholes 10 are ordinarily arranged substantially uniformly throughout the area to be worked, preferably in parallel rows as illustrated. In the illustrated instance, each of these injection boreholes 10 terminates near the bottom of the water-flooded, porous oil shale stratum 12 and is cased throughout its length. As illustrated, the lower ends of the casings are open for steam ejection therethrough. However, such lower ends can be closed or left partially open and the casings perforated at intervals along the thickness of stratum 12 so that steam is injected into the stratum at such intervals to effect any desired distribution of the heat so introduced. In some instances, it may be advantageous to terminate boreholes 10 at different levels within the lower half of stratum 12 to effect better distribution of the injected steam.

A series of extraction boreholes 14 are drilled through overburden 11 into stratum 12 in an arrangement which is also ordinarily substantially uniform throughout the area to be worked, preferably in parallel rows and spaced substantially equidistant from injection boreholes 10. They are cased throughout their lengths as are the injection boreholes. Preferably, they terminate near the top of stratum 12, although, as with the injection boreholes, they may terminate at different levels or be perforated along their lower end portions. In any event, they preferably terminate within the upper half of stratum 12.

Equipment is provided for generating superheated steam, for separating mixed shale oil and gas and carrier water withdrawn from the water-flooded, shale oil formation, and for recycling at least some of the carrier water into the formation as superheated steam. Such equipment is advantageously located at the surface and may comprise a steam generating plant 15 of conventional construction, including appropriate water conditioning facilities. Conventional means 16 for separating the recovered shale oil and gas and the carrier water is advantageously located adjacent to steam generating plant 15. Feed piping 17 interconnects steam generating plant 15 with the individual injection boreholes 10, and delivery piping 18 interconnects the individual extraction boreholes 14 with separator 16.

Shale oil is passed from separator 16 to suitable processing or storage facilities (not shown) by piping 16*a* and any gas from the oil shale is passed through piping 16*b* to steam generating plant 15 as fuel. Carrier water is passed by piping 16*c* to a holding reservoir 19.

Water from reservoir 19 is pumped through piping 20 to steam generating plant 15 for conditioning, conversion to superheated steam, and recycling into the formation through injection boreholes 10. Water not required for steam is either passed to waste as overflow from reservoir 19 or is pumped through piping 21 and piping 17 to one or more of the injection wells as may be found desirable in quantity and on a time schedule that does not conflict with steam injection. Such re-introduced water can aid in sweeping evolved shale oil and gas from the pores of the oil shale.

In operation, superheated steam at a temperature of about 1000° F. and a pressure of about 1500 p.s.i.g. is injected into water-flooded, naturally porous, oil shale stratum 12 by way of injection boreholes 10. As the superheated steam is injected into stratum 12, it transfers heat to the oil shale and to the water that floods such stratum, thereby in effect retorting the oil shale and converting its kerogen content to shale oil in liquid or vapor form, usually accompanied by minor quantities of gas. The thereby released shale oil and gas are collected by the water and carried thereby toward, into, and through the extraction boreholes 14.

It should be noted that the movement of the heated water through the formation aids in extracting the shale oil, as formed, from the host rock. Moreover, the water naturally occurring in the formation tends to contain the injected steam and confine the heat as well as the shale oil products within a limited area.

It should be apparent that the exact steam injection temperature, pressure, and rate in any given instance will depend upon the circumstances and that calculations will have to be made in accordance with sound engineering practice based upon available data concerning the particular oil shale formation and the conditions peculiar thereto.

Figure 2:
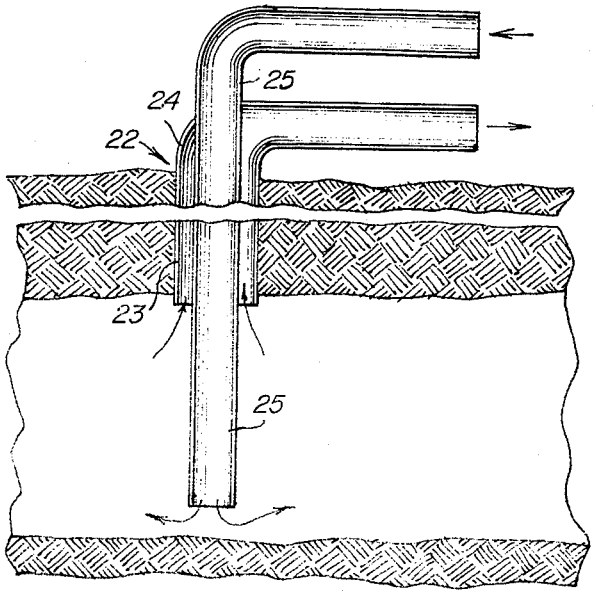

Separate sets of injection boreholes 10 and extraction boreholes 14 can be provided as illustrated in FIG. 1, or an appropriate number of double cased boreholes, FIG. 2, can be used to combine injection and extraction at each of the several locations. A typical double cased borehole is shown at 22 in FIG. 2. In providing same, a borehole is drilled into the upper portion of the stratum to be worked and is cased throughout its length with a casing 23. A second, smaller diameter borehole 24 is drilled concentrically with the first into the lower portion of the stratum, terminating preferably adjacent to the lower face thereof. A corresponding casing 25 extends from the surface downwardly through casing 23 into and through the second borehole 23 as casing therefor. Superheated steam is injected into the lower portion of the stratum through casing 25 and a mixture of water and oil shale products is withdrawn through casing 23.

Figure 3:
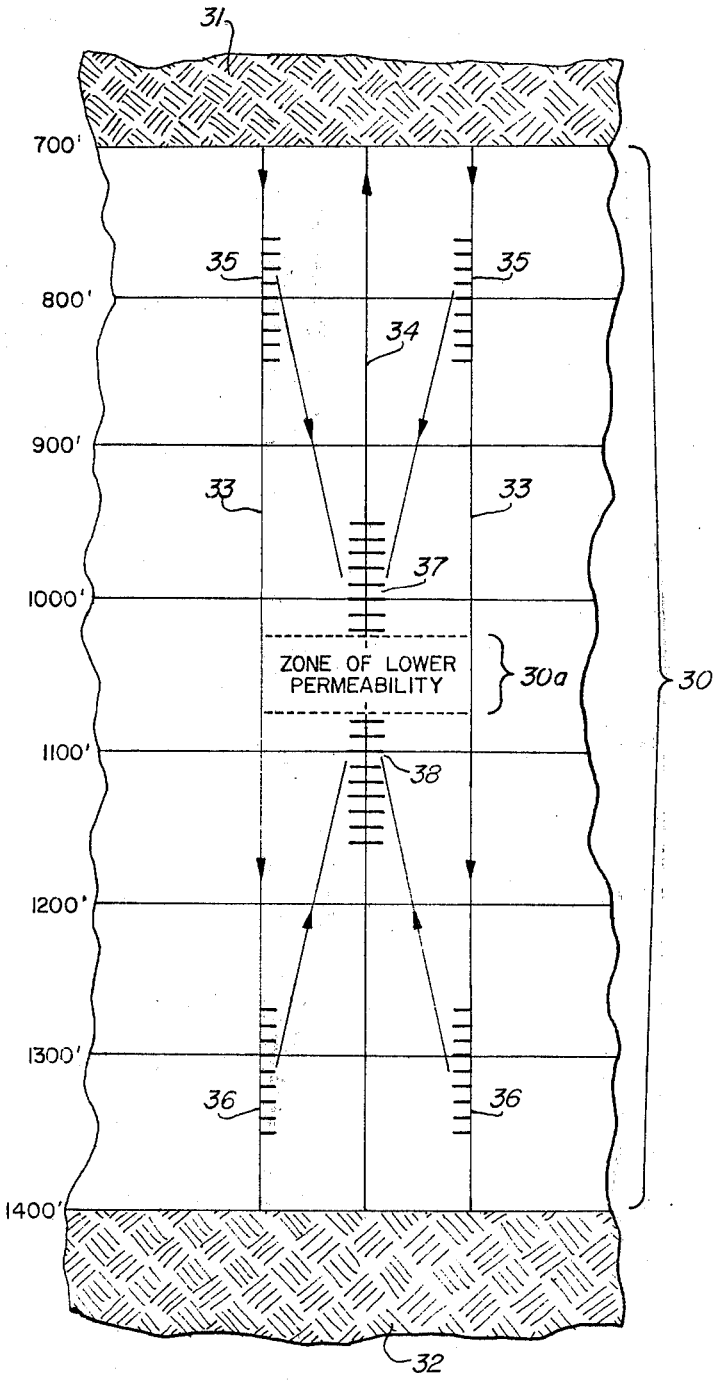

As is indicated schematically in FIG. 3, which represents an actual pilot installation of an in situ plant in accordance with the invention in the Piceance Creek Basin in Colorado designed to carry out the process of the invention within a water-flooded permeable zone 30 of an underground oil shale deposit lying between an upper substantially dry and impermeable "mahogany" oil shale zone 31 and a lower substantially dry, salt-impregnated and normally impermeable oil shale zone 32 that has heretofore been regarded as a workable zone for the in situ recovery of shale oil values by reason of its permeability once the salt is leached out by the introduction of a solvent, usually hot water. Because the zone 30, shown here to extend from the 700 foot level to the 1400 foot level, is water-flooded, it has been avoided heretofore in previous efforts to recover oil shale values by in situ procedures.

In applying the process of the invention to this water-flooded permeable zone 30, it has been found that there is an intermediate portion 30*a* of lower permeability than other portions lying above and below such intermediate portion, and it has been found advantageous to drill and case sets of injection boreholes 33 and extraction borehole 34 into and through zone 30, perforating the injection casings within upper and lower portions of zone 30, as at 35 and 36, respectively, and perforating the extraction casing immediately above and immediately below the intermediate portion 30*a*, as at 37 and 38, respectively. In this way, injection of superheated steam (preferably supplied at 1000° F. and at 1500 p.s.i.g.) and extraction of the water-carried shale oil values are accomplished most effectively.

This embodiment of the invention may be advantageously employed regardless of the presence of the above-mentioned intermediate portion of lower permeability.

Present indications are that shale oil produced in accordance with the invention is superior in quality to shale oil produced in surface retorts. Typically, it has an API gravity several degrees higher than oil produced from the same oil shale by the modified Fisher Assay process. Its pour point is 10°–20° F. lower and its nitrogen content is considerably lower than the pour point and nitrogen content of shale oil produced in surface retorts.

In any given installation, there will be at least one injection borehole and one recovery borehole spaced apart sufficiently to establish an effective working zone in the water-flooded stratum of oil shale concerned. As a practical matter and as here specifically indicated, there will usually be a number of both injection and recovery boreholes spaced apart and arranged appropriately considering the underground formation being worked. In all instances, it has been found desirable to pass the superheated steam into each injection well by means of relatively small diameter tubing suspended within the well casing and terminating in a discharge opening above the bottom of such borehole, e.g. at about two-thirds of the total well depth, the steam then finding its way to the perforation discharge openings in the well casing.

Although there are here illustrated and specifically described certain preferred embodiments presently regarded as the best mode of carrying out the invention, it should be understood that various changes may be made and other procedures adopted without departing from the inventive subject matter particularly pointed out in the following claims.

What I claim is:

1. An in situ process for recovering shale oil and gas from a naturally water-flooded, naturally porous zone in a subterranean oil shale formation, comprising drilling at least one injection borehole and at least one extraction borehole into such a naturally water-flooded, naturally porous zone of the subterranean oil shale formation; injecting superheated steam through said injection borehole and into said water-flooded zone of the oil shale formation to heat the oil shale and the water in said zone and to convert kerogen in the heated oil shale to shale oil in liquid or vapor form; collecting in and carrying along with the water in said zone, and with water resulting from the condensation of the injected steam, the shale oil and any gas occurring therewith; and withdrawing the mixture of shale oil, gas, and carrier water from the said zone through said extraction borehole.

2. A process in accordance with claim 1, including separating the shale oil and gas and carrier water in the withdrawn mixture; converting at least a portion of said carrier water to superheated steam; and recycling said portion of carrier water to the water-flooded, naturally porous zone of the subterranean oil shale formation through the at least one injection borehole as superheated steam.

3. A process in accordance with claim 2, wherein part of the carrier water is not converted to steam, and at least part of such carrier water not converted to steam is reinjected into the water-flooded zone of the oil shale formation as water.

4. A process in accordance with claim 1, wherein a plurality of both the injection and the extraction boreholes are drilled into the formation zone so as to be spaced substantially uniformly throughout the areal extent of said zone.

5. A process in accordance with claim 4, wherein the injection boreholes extend substantially vertically into the bottom half of the formation zone, and the extraction boreholes extend substantially vertically into the upper half of said zone.

6. A process in accordance with claim 1, wherein the water-flooded, naturally porous zone of the subterranean oil shale formation is sandwiched between substantially impervious upper and lower strata.

7. A process in accordance with claim 1, wherein the steam is injected adjacent to both the bottom and top of the water-flooded zone and the mixture of shale oil, gas, and carrier water is withdrawn between the locations of steam injection intermediate the vertical extent of the water-flooded zone.

8. A plant for recovering shale oil products from a naturally water-flooded, naturally porous zone of a subterranean oil shale formation, comprising at least one injection borehole extending from the surface of the earth into said zone; at least one recovery borehole extending from the surface of the earth into said zone in spaced relation to said injection borehole; means for generating superheated steam and passing it into said at least one injection borehole; and means for receiving and separating a mixture of shale oil products and carrier water recovered from said at least one recovery borehole.

9. A plant in accordance with claim 8, including means for conditioning and for passing at least a portion of the separated carrier water to the means for generating superheated steam so it will be recycled into the formation zone as superheated steam.

10. A plant in accordance with claim 9, including means for passing at least a portion of the separated carrier water into the at least one injection well for recycling into the zone as water.

11. A plant in accordance with claim 8, wherein the at least one injection borehole and the at least one recovery borehole extend through the water-flooded zone and are cased, the casing of said injection borehole being perforated adjacent to both the top and the bottom of said water-flooded zone and the casing of said recovery borehole being perforated intermediate said top and bottom of the water-flooded zone between the locations of perforation of the casing of said injection borehole.

* * * * *